US010570497B2

(12) United States Patent
Inoue et al.

(10) Patent No.: US 10,570,497 B2
(45) Date of Patent: Feb. 25, 2020

(54) SURFACE TREATMENT METHOD AND SURFACE TREATMENT DEVICE

(71) Applicant: TOYOTA JIDOSHA KABUSHIKI KAISHA, Toyota-shi, Aichi-ken (JP)

(72) Inventors: Hiroyuki Inoue, Aichi (JP); Kazuomi Yamanishi, Tajimi (JP); Shinnichi Hiramatsu, Okazaki (JP); Izuru Yamamoto, Toyota (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 239 days.

(21) Appl. No.: 15/622,589

(22) Filed: Jun. 14, 2017

(65) Prior Publication Data

US 2017/0362695 A1 Dec. 21, 2017

(30) Foreign Application Priority Data

Jun. 20, 2016 (JP) ..... 2016-121911

(51) Int. Cl.
*C23C 8/26* (2006.01)
*C21D 9/00* (2006.01)
(Continued)

(52) U.S. Cl.
CPC ..... *C23C 8/26* (2013.01); *C21D 1/06* (2013.01); *C21D 1/34* (2013.01); *C21D 1/74* (2013.01);
(Continued)

(58) Field of Classification Search
CPC .... C23C 8/26; C23C 8/06; C21D 9/32; C21D 1/06; C21D 1/34; C21D 9/006; C21D 1/74
See application file for complete search history.

(56) References Cited

U.S. PATENT DOCUMENTS 4,763,880 A 8/1988 Smith et al.
5,340,412 A * 8/1994 Yoshino ..... C21D 6/004 148/208
(Continued)

FOREIGN PATENT DOCUMENTS

CN 88101735 A 10/1988
EP 1247875 A2 10/2002
(Continued)

OTHER PUBLICATIONS

Global Report, "Surface treatment with a high-intensity arc lamp", Advanced Materials & Processes, vol. 138, No. 3, Sep. 1990, XP 000148436, pp. 37-41.
(Continued)

*Primary Examiner* — Jessee R Roe
(74) *Attorney, Agent, or Firm* — Sughrue Mion, PLLC

(57) ABSTRACT

There is provided a surface treatment method in which a processing gas is brought in contact with a heated processing object made of steel, an element in the processing gas is solid-solutionized, and thus a surface treatment is performed on the processing object. The processing object is heated to a heating temperature in a vicinity of a processing temperature at which the surface treatment is performed by heating an atmosphere in which the processing object is disposed. The surface treatment is performed by bringing the processing gas in contact with a surface of the processing object while the processing object which is heated is directly heated to the processing temperature.

9 Claims, 5 Drawing Sheets

(51) Int. Cl.

| | |
|---|---|
| ***C23C 8/06*** | (2006.01) |
| ***C21D 1/74*** | (2006.01) |
| ***C21D 1/06*** | (2006.01) |
| ***C21D 1/34*** | (2006.01) |
| ***C21D 9/32*** | (2006.01) |

(52) U.S. Cl.

CPC ..... *C21D 9/0006* (2013.01); *C21D 9/32* (2013.01); *C23C 8/06* (2013.01); *C21D 2211/001* (2013.01)

(56) References Cited

U.S. PATENT DOCUMENTS

| | | | | |
|---|---|---|---|---|
| 5,650,022 | A * | 7/1997 | Kitano | C23C 8/34 148/228 |
| 5,676,769 | A | 10/1997 | Kawamura et al. | |
| 2002/0166607 | A1 | 11/2002 | Altena et al. | |
| 2008/0050635 | A1 * | 2/2008 | Gao | C23C 8/26 429/509 |
| 2012/0168033 | A1 | 7/2012 | Heuer et al. | |

FOREIGN PATENT DOCUMENTS

| | | | |
|---|---|---|---|
| JP | 53117529 | U | 9/1978 |
| JP | 5794564 | A | 6/1982 |
| JP | 03-260048 | A | 11/1991 |
| JP | 04243122 | A | 8/1992 |
| JP | 08-199331 | A | 8/1996 |
| JP | H10-097999 | A | 4/1998 |
| JP | 2004-217958 | A | 8/2004 |
| JP | 2004-360057 | A | 12/2004 |
| JP | 2009057606 | A | 3/2009 |
| JP | 2014-118606 | A | 6/2014 |
| JP | 2016069671 | A | 5/2016 |
| RU | 2034091 | C1 | 4/1995 |
| RU | 2367715 | C2 | 9/2009 |
| SU | 735316 | A | 5/1980 |
| WO | 2011009463 | A1 | 1/2011 |

OTHER PUBLICATIONS

Minkevich A.N., "Thermochemical Treatment of Metals and Alloys", Moscow, 'Mashinostroenie' Publisher, 1965, pp. 22-23 (3 pages total).

Partial Translation of Communication dated Nov. 13, 2018, from the Russian Federal Service for Intellectual Property in counterpart Application No. 2017120794/02.

Partial English Translation of Communication dated Jun. 14, 2018 from the Russian Patent and Trademark Office in counterpart application No. 2017120794/02.

* cited by examiner

EXAMPLE 1

COMPARATIVE EXAMPLE 3

SURFACE TREATMENT METHOD AND SURFACE TREATMENT DEVICE

INCORPORATION BY REFERENCE

The disclosure of Japanese Patent Application No. 2016-121911 filed on Jun. 20, 2016 including the specification, drawings and abstract is incorporated herein by reference in its entirety.

BACKGROUND

1. Technical Field

The present disclosure relates to a surface treatment method and a surface treatment device through which a processing gas is brought in contact with a heated processing object made of steel, and an element included in the processing gas is solid-solutionized to perform a surface treatment on the processing object.

2. Description of Related Art

When a processing object made of steel is subjected to a surface treatment, the processing object is heated, a processing gas is brought in contact with the processing object, and an element included in the processing gas is solid-solutionized in a surface of the processing object. As such a technique, for example, Japanese Patent Application Publication No. 2004-217958 (JP 2004-217958 A) proposes the following surface treatment method. In the surface treatment method, the processing object is heated through inductive heating, laser emission heating, or infrared radiation heating, a processing gas such as a nitriding treatment gas is brought in contact with a surface of the heated processing object, and thus a surface treatment is performed on the processing object.

In addition, Japanese Patent Application Publication No. 2014-118606 (JP 2014-118606 A) proposes the following surface treatment method. In the surface treatment method, first, a processing object is heated through high frequency inductive heating in a temperature raising unit. Next, the processing object is transferred to a carburizing treatment unit and under an atmosphere of a carburizing treatment gas, the atmosphere is heated, and thus a carburizing treatment is performed on the processing object. Next, the carburized processing object is transferred to a nitriding treatment unit, and the residual heat of the processing object in the carburizing treatment is used to bring ammonia gas in contact with the processing object to perform a nitriding treatment.

SUMMARY

In the surface treatment method according to JP 2004-217958 A, since a processing object is directly heated without heating an atmosphere around the processing object, a processing gas decomposes or reacts on the heated surface of the processing object and thus a surface treatment may be performed.

However, for example, when the processing object is inductively heated, since it is difficult to keep a constant gap between the entire treatment surface of the processing object and an inductive heating coil, it is difficult to uniformly heat the processing object. On the other hand, when the processing object is heated by emission of light such as laser beams or infrared radiation, it is difficult to uniformly emit light to the entire treatment surface of the processing object. In particular, when a surface treatment is performed on a processing object having a complicated shape, it is difficult to uniformly heat a surface of the processing object. As a result, it is considered difficult to uniformly treat the surface of the processing object.

Considering this point, as disclosed in JP 2014-118606 A, when an atmosphere around the processing object is heated, it is possible to uniformly heat the surface of the processing object. However, in this case, there is a possibility of the processing gas decomposing or reacting before it reaches the surface of the processing object, and there is a possibility of a surface treatment not being efficiently performed. Further, when the residual heat of the processing object whose surface is uniformly heated is used to bring a processing gas in contact with the processing object, since a surface temperature of the processing object decreases as time elapses, it is not possible to efficiently perform the surface treatment.

The present disclosure provides a surface treatment method and a surface treatment device through which it is possible to efficiently perform a surface treatment while the surface of the processing object is more uniformly heated.

In view of the above problems, the inventors conducted extensive studies and as a result, found that, before a processing object is subjected to a surface treatment using a processing gas, when an atmosphere in which the processing object is disposed is heated, it is possible to uniformly heat the surface of the processing object in advance. Next, it is speculated that, while the uniformly heated processing object is directly heated, if a processing gas is brought in contact with the processing object, the surface of the processing object remains at a substantially uniform temperature and an element included in the processing gas can be uniformly solid-solutionized in the surface of the processing object.

A first aspect of the present disclosure is a surface treatment method in which a processing gas is brought in contact with a heated processing object made of steel, an element included in the processing gas is solid-solutionized, and thus a surface treatment is performed on the processing object, including heating the processing object to a heating temperature in a vicinity of a processing temperature at which the surface treatment is performed by heating an atmosphere in which the processing object is disposed; and performing the surface treatment by bringing the processing gas in contact with a surface of the processing object while the processing object which is heated is directly heated to the processing temperature.

In the first aspect, ammonia gas may be used as the processing gas and a nitriding treatment may be performed as the surface treatment. It is possible to prevent the ammonia gas from decomposing before it comes in contact with the surface of the processing object and it is possible to efficiently solid-solutionize nitrogen of ammonia gas in the surface of the processing object. In addition, an inert gas, for example, nitrogen gas and the like, may be used as an atmosphere gas during the heating.

In the first aspect, when the surface treatment is performed, the processing object may be directly heated by emission of light to the processing object. In addition, the emission of the light to the processing object may be performed using an infrared lamp.

In the first aspect, the processing object may be a gear. Even if the processing object has a complicated shape such as a gear, it is possible to bring the processing gas in contact with the surface of the processing object while the temperature of the surface of the processing object is substantially uniform.

In the first aspect, the heating temperature may have a range of a temperature 100° C. lower than the processing temperature to a temperature 120° C. higher than the processing temperature. In addition, the heating temperature may be 850° C. or higher and 1200° C. or lower.

In the first aspect, the processing object is heated to the heating temperature in a heating chamber, and the surface treatment on the processing object is performed in a processing chamber. The surface treatment method may further include transferring the processing object from the heating chamber to the processing chamber after the processing object is heated to the heating temperature.

A second aspect of the present disclosure is a surface treatment device that includes a temperature raising unit configured to heat a processing object and a treatment unit configured to perform a surface treatment by bringing a processing gas in contact with the processing object heated by the temperature raising unit and solid-solutionizing an element included in the processing gas. The temperature raising unit includes a heating chamber in which the processing object is disposed and a first heating unit configured to heat the processing object by heating an atmosphere in the heating chamber in which the processing object is disposed. The treatment unit includes a processing chamber in which the processing object is disposed, a gas supply unit configured to supply the processing gas to the processing chamber, and a second heating unit configured to directly heat the processing object in the processing chamber.

In the second aspect, the gas supply unit may supply ammonia gas as the processing gas. It is possible to prevent the ammonia gas from decomposing before it comes in contact with the surface of the processing object and it is possible to efficiently solid-solutionize nitrogen of ammonia gas in the surface of the processing object.

In the second aspect, the processing chamber includes a light transmitting wall having light transmittance on at least a part of walls that define the processing chamber and the second heating unit is disposed outside the processing chamber, emits light to the processing object in the processing chamber through the light transmitting wall, and may heat the processing object. It is possible to directly heat the processing object by emission of light to the processing object through the light transmitting wall.

In the second aspect, the light transmitting wall includes a first wall facing an outside of the processing chamber and a second wall facing an inside of the processing chamber. A space may be between the first wall and the second wall. When a space is provided in the light transmitting wall, the space can insulate from heat generated by the second heating unit itself and heat transfer from the first wall to the second wall due to the heat can be prevented. Accordingly, the processing gas can be prevented from decomposing or reacting on the surface of the second wall and the vicinity thereof.

In the second aspect, a mounting net on which the processing object is mounted may be disposed in the processing chamber.

In the second aspect, a transfer unit configured to transfer the processing object from the heating chamber to the processing chamber may be further included. In addition, the transfer unit may include a passage configured to be sealed and a suction pump configured to remove air in the passage. Accordingly, since the processing object is transferred in a reduced pressure state or a vacuum state, the surface of the processing object is prevented from being oxidized, a decrease in the temperature of the processing object heated by the temperature raising unit is reduced, and the processing object can be transferred to the treatment unit.

According to the present disclosure, when the atmosphere is heated, it is possible to more uniformly heat the surface of the processing object. When the heated processing object is directly heated, it is possible to efficiently perform a surface treatment on the processing object using a processing gas while the processing object remains at a substantially uniform temperature.

BRIEF DESCRIPTION OF THE DRAWINGS

Features, advantages, and technical and industrial significance of exemplary embodiments will be described below with reference to the accompanying drawings, in which like numerals denote like elements, and wherein.

DETAILED DESCRIPTION OF EMBODIMENTS

A surface treatment device and a surface treatment method according to embodiments of the present disclosure will be described below with reference to FIG. 1 and FIG. 2.

1. Surface Treatment Device 1

Figure 1:
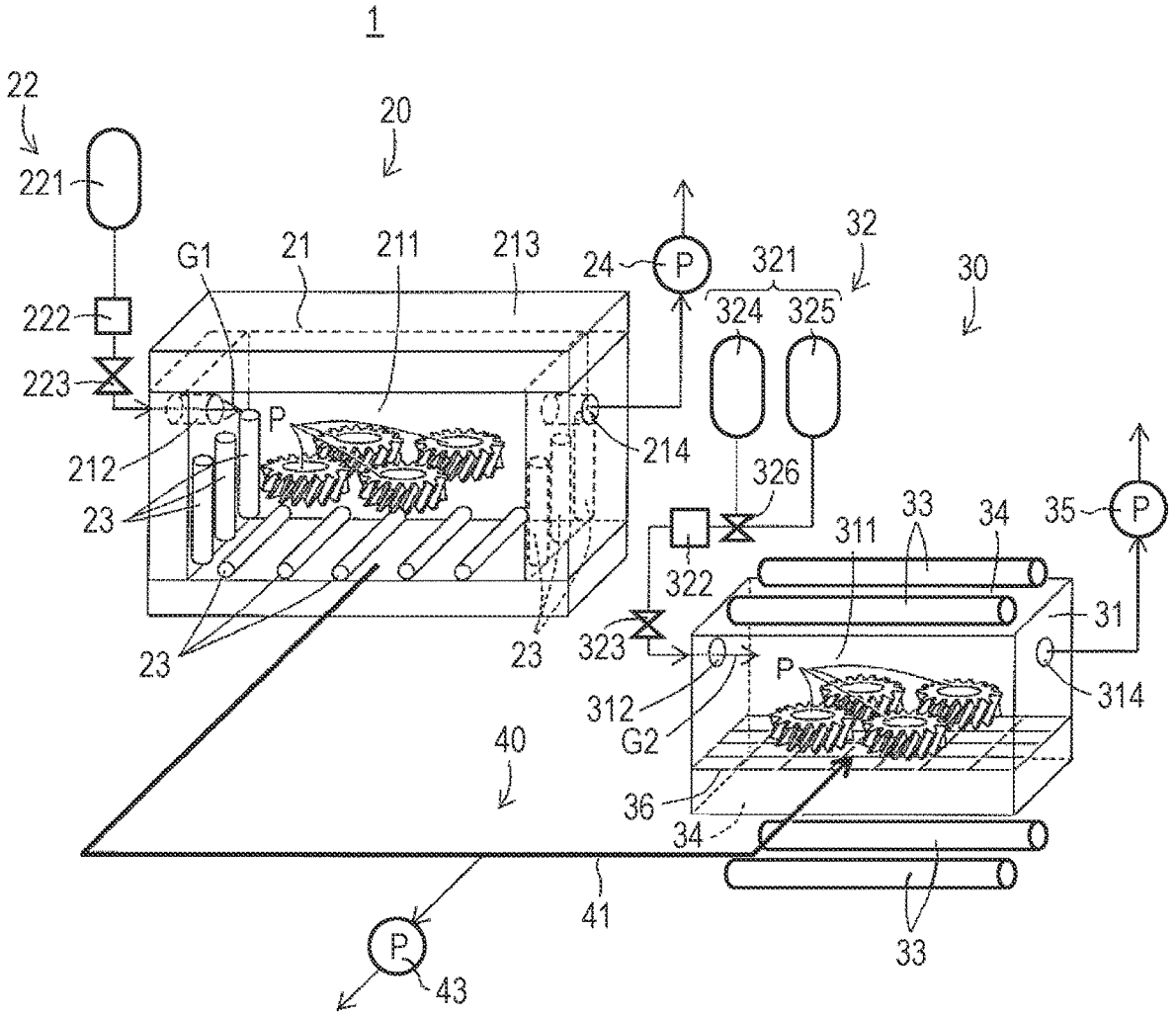
FIG. 1 is a schematic diagram of a surface treatment device according to an embodiment.

FIG. 1 is a schematic diagram of a surface treatment device 1 according to an embodiment of the present disclosure. The surface treatment device 1 according to the present embodiment is a device that brings a processing gas in contact with a heated processing object P and performs a surface treatment on the processing object P using a processing gas G2. As will be described below, the processing object P is a processing object made of steel. In the present embodiment, the processing object P is, for example, a gear.

As shown in FIG. 1, the surface treatment device 1 includes a temperature raising unit 20 configured to heat the processing object P and a treatment unit 30 configured to perform a surface treatment on the processing object P heated by the temperature raising unit 20 using the processing gas G2. The surface treatment device 1 may include a transfer unit 40 configured to transfer the processing object P from the temperature raising unit 20 to the treatment unit 30.

The surface treatment device 1 further includes a cooling chamber (not shown) in which the processing object P whose surface is treated by the treatment unit 30 is cooled and another transfer unit (not shown) configured to transfer the processing object P into the cooling chamber from the treatment unit 30. Note that the above-described cooling chamber and other transfer unit may not be provided as long as the processing object P treated by the treatment unit 30 can be extracted and cooled by air cooling, oil cooling, water cooling, or the like.

1-1. Temperature Raising Unit 20

As shown in FIG. 1, the temperature raising unit 20 includes a heating chamber 21 in which the processing object P is disposed, an inert gas supply unit 22 configured to supply an inert gas G1 to an interior 211 of the heating chamber 21, and a first heating unit 23 configured to heat the processing object P by heating an atmosphere of the interior 211.

The heating chamber 21 has a space in which a plurality of processing objects P are disposed in the interior 211. A wall 213 forming the interior 211 is made of a material having a heat insulating ability and fire resistance that is used in, for example, a general electric heating furnace. Note that, in FIG. 1, with respect to the plane of the paper, front and rear walls are omitted for description. In addition, an installation table (not shown) on which the processing object P is installed is provided in the interior 211.

An inlet 212 is formed in the heating chamber 21 so that the inert gas G1 from the inert gas supply unit 22 is supplied to the interior 211. The inlet 212 communicates with the inert gas supply unit 22 so that the inert gas G1 can be supplied to the interior 211.

The inert gas supply unit 22 includes an inert gas supply source 221 filled with the inert gas G1 and a regulating valve 222 configured to regulate a flow rate of the inert gas G1 that is transmitted from the inert gas supply source 221 to the interior 211. In addition, the inert gas supply unit 22 includes a solenoid valve 223 configured to start and stop supply of the inert gas G1 to the interior 211. The inert gas G1 is a gas that does not have reactivity with a material of the processing object P. For example, nitrogen gas, helium gas, or argon gas may be exemplified.

In the heating chamber 21, an outlet 214 from which the inert gas G1 supplied to the interior 211 is discharged is formed. The outlet 214 is connected to a suction pump 24. As long as the inert gas G1 in the interior 211 can be discharged from the interior 211 through the outlet 214, the suction pump 24 may not be provided. In addition, when the processing object P is heated, the interior 211 is set to be in a reduced pressure state or a reduced pressure state close to a vacuum by the suction pump 24, and the inert gas supply unit 22 of the temperature raising unit 20 may not be provided.

In the present embodiment, the first heating unit 23 is an electric heater that heats an atmosphere of the interior 211. According to heating by the heater, an atmosphere (specifically, the inert gas G1) of the interior 211 in which the processing object P is disposed is heated and the processing object P is heated. In the present embodiment, the first heating unit 23 is a heater but is not particularly limited to, for example, a burner, as long as an atmosphere of the interior 211 can be heated when the first heating unit 23 is heated.

1-2. Treatment Unit 30

As shown in FIG. 1, the treatment unit 30 includes a processing chamber 31 in which the processing object P is disposed, a processing gas supply unit 32 configured to supply the processing gas G2 to an interior 311 of the processing chamber 31, and a second heating unit 33 configured to directly heat the processing object P in the interior 311 of the processing chamber 31. In the present embodiment, the second heating unit 33 is a device configured to heat the processing object P by emitting light to the processing object P.

The processing chamber 31 has a space in which the plurality of processing objects P are disposed in the interior 311. In the interior 311, a mounting net 36 on which the plurality of processing object P are mounted is disposed. When the mounting net 36 is used, it is possible to emit light of the second heating unit 33 to be described below from below the processing object P disposed on the mounting net 36.

At least a part of walls that form the interior 311 includes a light transmitting wall 34 having light transmittance. Here, as a material of the light transmitting wall 34, for example, a ceramic having light transmittance or a resin having heat resistance may be exemplified. As a ceramic, for example, quartz (crystal), quartz glass, or single crystal sapphire alumina or the like may be exemplified, and the ceramic is not particularly limited as long as it is possible to transmit light from the second heating unit 33 to be described below. In the present embodiment, quartz glass is used for the light transmitting wall 34 since it is inexpensive and has high workability. In addition, the light transmitting wall 34 may be formed in a portion in which light of the second heating unit 33 is transmitted to the interior 311, and the entire wall forming the interior 311 may be formed of the light transmitting wall 34.

Figure 2:
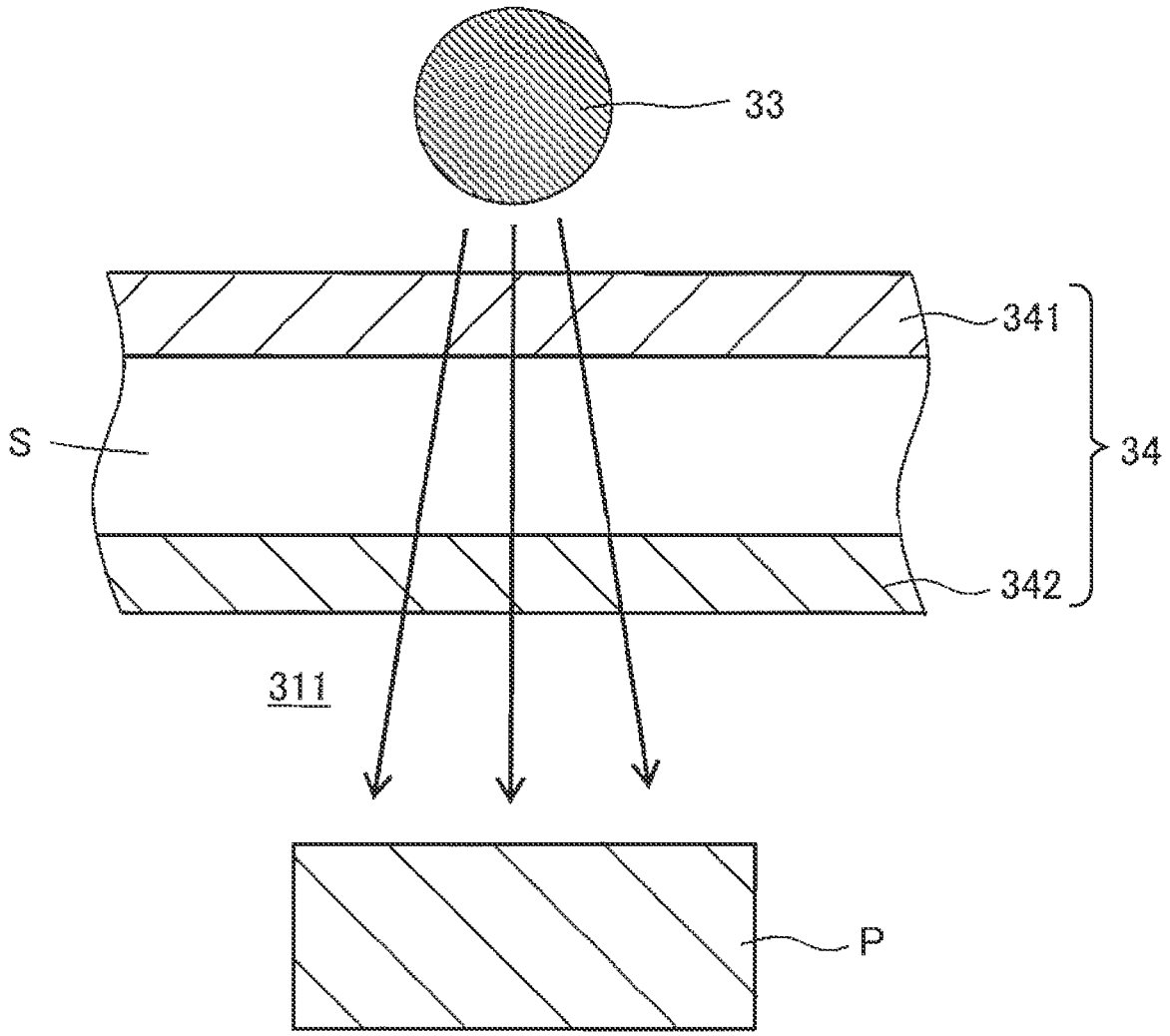
FIG. 2 is an enlarged cross-sectional view of a wall of a treatment unit of the surface treatment device shown in FIG. 1.

In the present embodiment, as shown in FIG. 2, the light transmitting wall 34 includes a first wall 341 facing the outside of the chamber and a second wall 342 facing the interior 311. Both the first wall 341 and the second wall 342 are formed of a material having light transmittance and these are disposed apart from each other. Accordingly, a space S is formed between the first wall 341 and the second wall 342.

When the space S is provided in the light transmitting wall 34, the space S insulates from heat generated by the second heating unit 33 itself to be described below and heat transfer from the first wall 341 to the second wall 342 due to the heat can be prevented. As a result, the processing gas G2 can be prevented from decomposing or reacting on the surface of the second wall 342 facing the interior 311 and the vicinity thereof.

Air (atmospheric air) may be present in the space S and the space S may be, for example, in a reduced pressure state that is a state closer to a vacuum with respect to outside of the processing chamber 31. Accordingly, as will be described below, it is possible to improve a heat insulating ability between the first wall 341 and the second wall 342. In addition, a fluid such as a gas or a liquid may be filled into the space S and the fluid may continuously flow in the space S. Heat generated by the second heating unit 33 itself is absorbed by the fluid in the space S and heat transfer from the first wall 341 to the second wall 342 due to the heat can be prevented.

An inlet 312 is formed in the processing chamber 31 so that the processing gas G2 from the processing gas supply unit 32 is supplied to the interior 311. The inlet 312 communicates with the processing gas supply unit 32 so that the processing gas G2 can be supplied to the interior 311.

In the present embodiment, the processing gas supply unit 32 includes a processing gas supply source 321 filled with the processing gas G2 and a regulating valve 322 configured to regulate a flow rate of the processing gas G2 that is transmitted from the processing gas supply source 321 to the interior 311. In addition, the processing gas supply unit 32 includes a solenoid valve 323 configured to start and stop supply of the processing gas G2 to the interior 311.

The processing gas G2 is a gas that is used for a surface treatment on the processing object P. For example, when a carburizing treatment is performed as a surface treatment, a carburizing treatment gas is used. As the carburizing treatment gas, for example, a hydrocarbon gas may be exemplified. As a hydrocarbon gas, for example, acetylene gas, methane gas, or propane gas may be exemplified. In addition, when a nitriding treatment is performed as the a surface treatment, a nitriding treatment gas is used. As the nitriding treatment gas, ammonia gas may be exemplified. In addition, when a sulfurizing treatment is performed as the a surface treatment, a processing gas containing hydrogen sulfide gas may be exemplified. An inert gas, for example, nitrogen gas, may be additionally mixed with the processing gas.

Also, in the present embodiment, as will be described below, as an example of the surface treatment, since the nitriding treatment is performed after the carburizing treatment, the processing gas supply source 321 includes a supply source 324 configured to supply a carburizing treatment gas and a supply source 325 configured to supply a nitriding treatment gas. The supply sources 324 and 325 can selectively supply a carburizing treatment gas and a nitriding treatment gas to the interior 311 by a switching valve 326.

In the processing chamber 31, an outlet 314 from which the processing gas G2 supplied to the interior 311 is discharged is formed. The outlet 314 is connected to a suction pump 35. As long as the processing gas G2 in the interior 311 and the like can be discharged from the interior 311 through the outlet 314, the suction pump 35 may not be provided.

The second heating unit 33 is a device that is disposed outside the processing chamber 31, emits light to the processing object P in the interior 311 through the light transmitting wall 34, and thus directly heats the processing object P. Specifically, in the present embodiment, the second heating unit 33 is a heating lamp such as an infrared lamp (a halogen lamp) that performs infrared radiation to the processing object P as light and thus directly heats the processing object P. When the second heating unit 33 emits light to the processing object P, since it is possible to directly heat the processing object P, it is possible to substantially uniformly heat a surface area of the processing object P to which light is emitted. As long as it is possible to directly heat the processing object P by emission of light to the processing object P, for example, a laser emitting device configured to emit laser beams as light to the processing object P may be used. In addition, when the second heating unit 33 is an infrared lamp, a reflective member reflecting infrared radiation may be provided at a position opposite to the processing chamber 31 with respect to the second heating unit 33. Accordingly, it is possible to reflect infrared radiation to the processing chamber 31.

Here, the second heating unit 33 is not particularly limited as long as it is a device configured to directly heat the processing object P in the interior of the processing chamber 31. The term "direct heating" herein refers to heating that is not caused by heat transfer from an atmosphere in which the processing object P is disposed, that is, heating a processing object by applying energy other than heat to the processing object P. Therefore, in addition to a device configured to heat the processing object P by emitting light, an inductive heating device that is disposed inside or outside the processing chamber 31 and performs high-frequency inductive heating on the processing object P may be used as the second heating unit 33. In addition, an electric heating device configured to electrically heat the processing object P by applying a current to the processing object P may be used.

1-3. Transfer Unit 40

The transfer unit 40 is a device configured to transfer the processing object P from the temperature raising unit 20 to the treatment unit 30. In the transfer unit 40, a passage 41 through which the processing object P is transferred from the heating chamber 21 to the processing chamber 31 is formed. In the passage 41, a conveyor (not shown) through which the processing object P is transferred from the heating chamber 21 to the processing chamber 31 is disposed. Note that the transfer unit 40 may not be provided as long as it is possible to quickly transfer the processing object P from the heating chamber 21 to the processing chamber 31.

The passage 41 can form an enclosed (sealed) space inside the passage. A suction pump 43 configured to suction air in the passage 41 is connected. When the suction pump 43 is driven, it is possible to remove air in the passage 41 and the inside of the passage 41 can be set to be in a reduced pressure state or a reduced pressure state close to a vacuum.

Accordingly, it is possible to make it difficult for the surface of the processing object P extracted from the temperature raising unit 20 to be oxidized and it is possible to transfer the processing object P to the treatment unit 30 while insulating from heat of the processing object P heated by the temperature raising unit 20.

2. Processing Object P

The processing object P on which the surface treatment according to the present embodiment is performed is a processing object made of steel. The processing object P may be steel having a ferrite structure or a pearlite structure. As the steel, for example, steel including C: 0.1 to 0.3 mass %, Si: 0.15 to 0.35 mass %, Mn: 0.55 to 0.95 mass %, P: 0.03 mass % or less, S: 0.03 mass % or less, and the remainder being inevitable impurities and Fe may be exemplified.

Here, C is an element for ensuring strength and hardness for the processing object P. When there is less than 0.1 mass % of C, the hardness of the base material itself of the processing object P may be insufficient. On the other hand, when there is in excess of 0.3 mass % of C, machinability and cold forgeability of the processing object P before a treatment become degraded, the entire hardened base material undergoes martensite transformation, and due to the hardness of the base material itself being improved, toughness of the gear itself may be reduced.

Si is an element which improves hardenability and when there is less than 0.15 mass % of Si, hardenability of the processing object P may be lowered. On the other hand, when there is in excess of 0.35 mass % of Si, machinability and toughness of the processing object P may be lowered.

Mn is an element which improves hardenability, similarly to Si, and when there is less than 0.55 mass % of Mn, there is a likelihood of hardenability of the processing object P being lowered. On the other hand, when there is in excess of 0.95 mass % of Mn, machinability of the processing object P may be lowered.

It is desirable that an amount of P or S added be small and when in excess of 0.03 mass % of P is added, segregation readily occurs, and shock resistance of the processing object P may be lowered. When there is in excess of 0.03 mass % of S, hot workability may be lowered.

Further, as necessary, at least one of Ni, Cr, and Mo may be additionally added to the above-described components in ranges of Ni: 0.25 mass % or less, Cr: 0.8 to 1.3 mass %, and Mo: 0.1 to 0.4 mass %.

When there is in excess of 0.25 mass % of Ni, hardness of the processing object P may be increased and toughness of the gear may be lowered. Cr is an element which, in addition to improving hardenability, improves wear resistance and corrosion resistance and when there is less than 0.8 mass % of Cr, hardenability of the processing object P may be lowered. On the other hand, when there is in excess of 1.3 mass % of Cr, hardness of the processing object P may be increased and toughness of the processing object P may lowered.

Mo is an element for improving hardenability. When the Mo concentration is less than 0.1 mass %, hardenability may be lowered. On the other hand, when the Mo concentration exceeds 0.4 mass %, hardness of the processing object P may be increased and toughness of the processing object P may be lowered.

Further, the processing object P may have a block shape or a cylindrical shape, but the shape is not particularly limited. The processing object may have an uneven surface so that it is difficult to uniformly heat the surface by glow heating using, for example, general infrared radiation. In the present embodiment, as an example, the processing object P is a gear. Gears such as a spur gear with external teeth or internal teeth, a helical gear, a double helical gear, a bevel gear, and a worm gear may be exemplified. A shape of a gear is not particularly limited as long as the gear includes a tooth tip and a tooth bottom.

3. Surface Treatment Method

Figure 3:
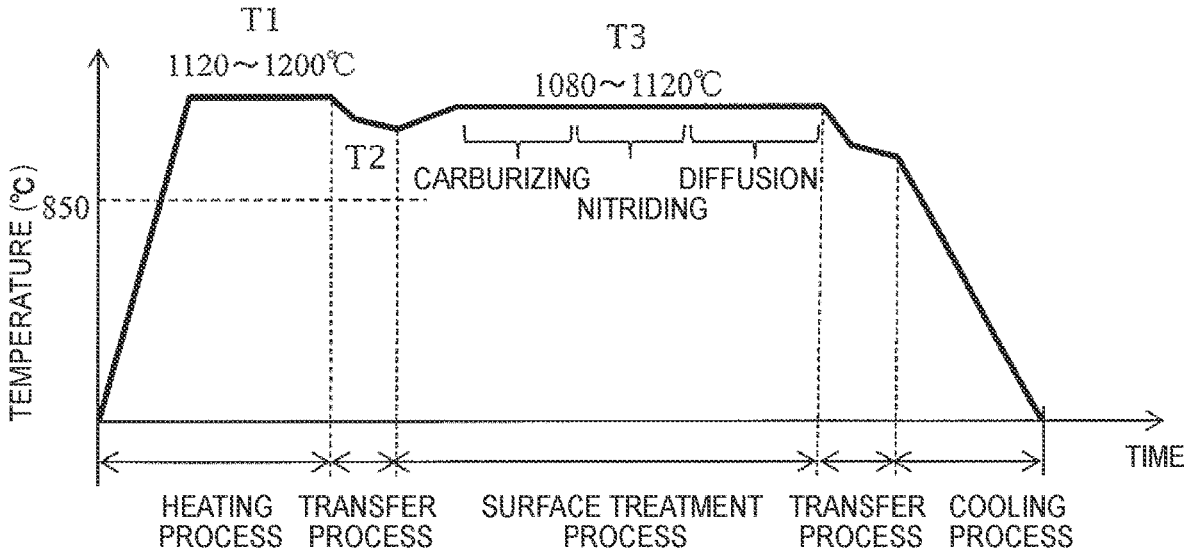
FIG. 3 is a diagram showing a temperature profile of a surface of a processing object for describing a surface treatment method according to an embodiment.

A surface treatment method according to the present embodiment will be described below with reference to FIG. 3 in addition to the surface treatment device 1 of FIG. 1 and FIG. 2. FIG. 3 is a diagram showing a temperature profile of a surface of the processing object P for describing the surface treatment method according to the embodiment of the present disclosure.

3-1. Heating Process

First, in the present embodiment, first, a plurality of processing objects P are disposed in the interior 211 of the heating chamber 21. In this state, the inert gas G1 whose flow rate is regulated by the regulating valve 222 is supplied from the inert gas supply source 221 to the interior 211 of the heating chamber 21. Accordingly, the interior 211 has an atmosphere of the inert gas G1.

Next, under the atmosphere of the inert gas G1 in the interior 211, when the atmosphere is heated by the first heating unit 23, the processing object P is heated to a heating temperature T1 in the vicinity of a processing temperature T3 at which a surface treatment is performed. Accordingly, in the treatment unit 30 to be described below, even if the processing object P is heated by emission of light, since the processing object P is heated to the vicinity of the processing temperature T3 in advance, the temperature of the surface of the processing object P hardly varies, and the surface of the processing object P can be uniformly treated.

Here, the heating temperature T1 may have a range of a temperature 100° C. lower than the processing temperature T3 to a temperature 120° C. higher than the processing temperature T3, that is, a range of (the processing temperature T3−100° C.) to (the processing temperature T3+120° C.). In particular, within the temperature range, the heating temperature T1 may be set to a temperature higher than the processing temperature T3. Accordingly, when the processing object P is transferred from the temperature raising unit 20 to the treatment unit 30, even if a temperature of the surface of the processing object P decreases, it is possible to quickly increase the temperature of the surface of the processing object P to the processing temperature T3 in the treatment unit 30.

As a specific temperature for the heating temperature T1, the heating temperature T1 may be 850° C. or higher on the assumption that the temperature is lower than a melting point of the processing object P. Accordingly, when the above-described surface treatment such as a carburizing treatment, a nitriding treatment, or a sulfurizing treatment is performed on the surface of the processing object P made of steel, it is possible to more uniformly heat the surface of the processing object P in the interior 311 of the treatment unit 30. The heating temperature T1 of the processing object P may be equal to or higher than an $A_3$ transformation point of steel of the processing object P. Accordingly, the structure of the processing object P is transformed to an austenitic structure, and it is possible to perform a surface treatment to be described below more quickly. Further, a temperature to which the processing object P is heated may be 1120° C. or higher and 1200° C. or lower.

3-2. Transfer Process

Next, the processing object P is transferred from the temperature raising unit 20 to the treatment unit 30. In the present embodiment, the inert gas G1 in the interior 211 of the heating chamber 21 is removed by the suction pump 24, the interior 211 is set to be in a reduced pressure state or a reduced pressure state close to a vacuum, air inside the passage 41 of the transfer unit 40 is also removed by the suction pump 43, and the inside of the passage 41 is set to be in a reduced pressure state or a reduced pressure state close to a vacuum. Similarly, air in the interior 311 of the processing chamber 31 is removed by the suction pump 35, and the interior 311 is set to be in a reduced pressure state or a reduced pressure state close to a vacuum. In this state, the processing object P is transferred from the temperature raising unit 20 to the treatment unit 30 through the transfer unit 40. Since the processing object P is transferred in a reduced pressure state or a vacuum state, the surface of the processing object P is prevented from being oxidized, a decrease in the temperature of the processing object P heated by the temperature raising unit 20 is reduced, and the processing object P can be transferred to the treatment unit 30. Note that a process of transferring the processing object P may be omitted as long as the heating process and a surface treatment process to be described below can be performed in one chamber.

Moreover, in the present embodiment, as long as the transfer unit 40 transfers the processing object P from the temperature raising unit 20 to the treatment unit 30 in a short time and it is possible to prevent a temperature T2 of the surface of the processing object P from decreasing during transfer, transfer may be performed without reducing the pressure. During transfer, the temperature T2 of the surface of the processing object P may be 850° C. or higher and 1200° C. or lower.

3-3. Surface Treatment Process

In the treatment unit 30, the processing object P is mounted on the mounting net 36. Next, the second heating unit 33 is used to emit light (infrared radiation) to the heated processing object P, and the surface of the processing object P is heated to the processing temperature T3. Accordingly, a carburizing treatment gas whose flow rate is regulated by the regulating valve 322 is supplied from the supply source 324. Accordingly, when a carburizing treatment gas which is a processing gas is brought in contact with the surface of the processing object P, the carburizing treatment is performed on the processing object P.

Specifically, the processing temperature T3 is a temperature at which a carburizing treatment can be performed on the processing object P, and may be 850° C. or higher or equal to or higher than an $A_3$ transformation point on the assumption that the temperature is lower than a melting point of the processing object P. Also, the processing temperature T3 may be 1080° C. or higher and 1120° C. or lower. Accordingly, the carburizing treatment can be performed as the surface treatment on the processing object P.

In the present embodiment, when infrared radiation is performed on the heated processing object P, since the surface of the processing object P is directly heated, it is possible to prevent the temperature of the wall surface forming the interior 311 from increasing in contrast to when an atmosphere around the processing object P is heated. As a result, a hydrocarbon gas which is a carburizing treatment gas is carbonized and it is possible to reduce adhesion of carbides such as soot to the wall surface forming the interior 311 and the like.

Further, in the present embodiment, since the surface of the processing object P is uniformly heated to the vicinity of the processing temperature T3 by the temperature raising unit 20, even if the surface of the processing object P is directly heated to the processing temperature T3 by the second heating unit 33, it is possible to substantially uniformly heat an area of the processing object P on which infrared radiation is performed. As a result, it is possible to keep the temperature of the surface of the processing object P substantially uniform.

As a result, for example, even if the processing object P has a complicated shape such as a gear, since it is possible to bring a carburizing treatment gas in contact with the surface while the temperature of the surface is substantially uniform, a uniform carburizing treatment can be performed on the surface.

Next, the processing gas G2 that is supplied to the interior 311 is switched from a carburizing treatment gas to a nitriding treatment gas by the switching valve 326 and a nitriding treatment is performed on the surface of the processing object P. Specifically, similarly to the carburizing treatment, the second heating unit 33 is used to emit light (infrared radiation) to the heated processing object P, the surface of the processing object P is heated to the processing temperature T3 and the temperature of the processing temperature T3 is maintained.

Accordingly, a nitriding treatment gas whose flow rate is regulated by the regulating valve 322 is supplied from the supply source 325. Accordingly, the nitriding treatment gas which is a processing gas is brought in contact with the surface of the processing object P, and the nitriding treatment can be performed on the processing object P.

Specifically, the processing temperature T3 is a temperature at which the nitriding treatment can be performed on the processing object P similarly to the carburizing treatment and may be 850° C. or higher or equal to or higher than an $A_3$ transformation point on the assumption that the temperature is lower than a melting point of the processing object P. The processing temperature T3 may be 1080° C. or higher and 1120° C. or lower.

In the present embodiment, similarly to the carburizing treatment, when infrared radiation is performed on the processing object P, since the surface of the processing object P is directly heated, it is possible to prevent the temperature of the wall surface forming the interior 311 from increasing in contrast to when an atmosphere around the processing object P is heated. As a result, in the interior 311, ammonia gas is prevented from decomposing in the interior 311 other than on the surface of the processing object P, and nitrogen of the ammonia gas can be efficiently solid-solutionized in the surface of the processing object P. Therefore, in contrast to when an atmosphere is heated to perform a nitriding treatment, since the temperature of the surface of the processing object P can be set to a higher temperature, solid-solutionizing of nitrogen can be promoted and the nitriding treatment can be performed in a shorter time.

Further, in the present embodiment, similarly to the carburizing treatment, since the surface of the processing object P is uniformly heated to the vicinity of the processing temperature T3 in advance by the temperature raising unit 20, it is possible to keep the temperature of the surface of the processing object P substantially uniform in the nitriding treatment also. As a result, even in the processing object P having a shape such as a gear, since the nitriding treatment gas can be brought in contact with the surface while the temperature of the surface is substantially uniform, a uniform nitriding treatment can be performed on the surface. Accordingly, a difference in quality between a tooth tip and a tooth base of a gear after the surface treatment can be prevented and occurrence of distortion in the gear can be prevented.

Next, while the processing temperature T3 is maintained, a nitriding treatment gas in the interior 311 is removed by the suction pump 35. The interior 311 is set to be in a reduced pressure state or a reduced pressure state close to a vacuum, and carbon and nitrogen solid-solutionized in the carburizing treatment and the nitriding treatment diffuse inside the processing object P.

Moreover, in the present embodiment, since a diffusion treatment to be described below may be performed after the nitriding treatment, supply of a carburizing treatment gas and supply of a nitriding gas to the interior 311 may be continuously performed by the solenoid valve 323. However, for example, supply of a carburizing treatment gas or a nitriding treatment gas to the interior 311 may be intermittently performed by the solenoid valve 323. Accordingly, carbon or nitrogen solid-solutionized in the surface of the processing object P can diffuse inside the processing object P when supply of a carburizing treatment gas or a nitriding treatment gas has been stopped.

In addition, in the present embodiment, as a method of directly heating the processing object P in the interior of the processing chamber 31, light may be emitted to the processing object P for heating. However, for example, "direct heating" refers to heating that is not caused by heat transfer from an atmosphere in which the processing object P is disposed, that is, heating a processing object by applying energy other than heat to the processing object P. Therefore, the processing object P may be directly heated through high frequency inductive heating or electrical heating.

3-4. Transfer Process and Cooling Process

The processing object on which the surface treatment is performed is extracted from the interior 311 of the treatment unit 30 and is transferred into a cooling chamber (not shown) by a transfer unit (not shown). The heated processing object P is cooled in the cooling chamber. The processing object P is cooled by any of air cooling, water cooling, oil cooling, or radiative cooling.

Moreover, in the present embodiment, the processing object P is transferred from the interior 311 of the treatment unit 30 into the cooling chamber and is then cooled. However, as long as the processing object P can be extracted from the interior 311 of the treatment unit 30 and cooled, the transfer unit and the cooling chamber may not be provided as described above.

While the carburizing treatment and the nitriding treatment are performed as the surface treatment in the present embodiment, only either the carburizing treatment or the nitriding treatment may be performed as the surface treatment, and a sulfurizing treatment may be performed in place of this surface treatment.

The present disclosure will be described below in detail with reference to examples.

EXAMPLE 1

A cylindrical specimen made of a steel material (JIS standard: SCr20) with a diameter of 20 mm and a length of 50 mm was prepared as a processing object. Next, the specimen was disposed in a heating chamber, a pressure inside the heating chamber was reduced, and while nitrogen gas flowed at a flow rate of 1000 L/h, an atmosphere around the specimen was heated to a heating temperature of 1120° C. by a heater serving as a first heating unit, and the processing object was heated at the heating temperature for a heating time of 50 minutes.

Next, the heated specimen was transferred from the temperature raising unit to the treatment unit by the transfer unit under a reduced pressure atmosphere close to a vacuum, a pressure inside the processing chamber was set to 500 Pa, and while ammonia gas flowed at a flow rate of 500 L/h, the specimen was kept at a processing temperature of 1100° C. using infrared radiation from a second heating unit, and was heated at the processing temperature for 10 minutes.

Then, the specimen was extracted from the processing chamber, nitrogen gas was sprayed on the specimen at a pressure of 10 bars for 10 minutes, and thus the specimen was cooled by the gas. It was determined whether a nitrided layer was formed on a surface of the obtained specimen.

TABLE 1

| | Heating process | | | | Surface treatment process (nitriding treatment) | | | | Cooling process |
|---|---|---|---|---|---|---|---|---|---|
| | Heating temperature (° C.) | Heating time (min) | Pressure (Pa) | Flow rate (L/h) | Heating temperature (° C.) | Heating time (min) | Pressure (Pa) | Flow rate (L/h) | Cooling time (min) |
| Example 1 | 1120 | 50 | Reduced pressure | 1000 | 1100 | 10 | 500 | 500 | 10 |
| Comparative Example 1 | 1050 | 50 | Reduced pressure | 1000 | None | 10 | 500 | 500 | 10 |
| Comparative Example 2 | 1050 | 50 | Reduced pressure | 1000 | None | 10 | 1400 | 500 | 10 |
| Comparative Example 3 | 1050 | 50 | Vacuum | — | None | 10 | 700 | 600 | 30 |
| Comparative Example 4 | 1050 | 50 | Vacuum | — | 700 | 10 | 700 | 500 | 10 |

COMPARATIVE EXAMPLE 1

In the same manner as in Example 1, a nitriding treatment was performed on a specimen. As shown in Table 1, a difference from Example 1 was a heating temperature that was 1050° C. in the heating process. Additional differences were that the specimen was not heated in a surface treatment process and the residual heat from during heating was used. It was determined whether a nitrided layer was formed on a surface of the obtained specimen.

COMPARATIVE EXAMPLE 2

In the same manner as in Example 1, a nitriding treatment was performed on a specimen. As shown in Table 1, a difference from Example 1 was a heating temperature that was 1050° C. in the heating process. Additional differences were that the specimen was not heated in the surface treatment process, the residual heat from during heating was used, a pressure inside the processing chamber was set to 1400 Pa, and ammonia gas flowed for 10 minutes. It was determined whether a nitrided layer was formed on a surface of the obtained specimen.

COMPARATIVE EXAMPLE 3

In the same manner as in Example 1, a nitriding treatment was performed on a specimen. As shown in Table 1, a difference from Example 1 was a heating temperature that was 1050° C. under a reduced pressure atmosphere close to a vacuum in the heating process. Additional differences were that the specimen was not heated in the surface treatment process, the residual heat from during heating was used, a pressure inside the processing chamber was set to 700 Pa, and ammonia gas flowed at a flow rate of 600 L/h for 30 minutes. It was determined whether a nitrided layer was formed on a surface of the obtained specimen.

COMPARATIVE EXAMPLE 4

In the same manner as in Example 1, a nitriding treatment was performed on a specimen. As shown in Table 1, a difference from Example 1 was a heating temperature that was 1050° C. under a reduced pressure atmosphere close to a vacuum in the heating process. Additional differences were that, while an atmosphere inside the processing chamber was heated to 700° C. by a heater in the surface treatment process, a pressure inside the processing chamber was set to 700 Pa and ammonia gas flowed. It was determined whether a nitrided layer was formed on a surface of the obtained specimen.

[Microscopic Observation]

Figure 4A:
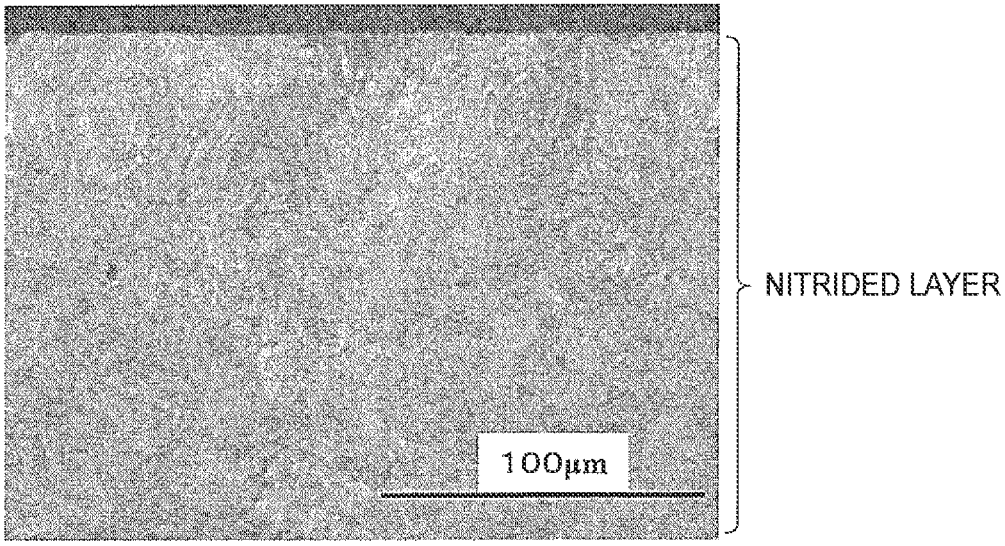
FIG. 4A is a photograph of a surface layer in a cross section of a specimen according to Example 1.
Figure 4B:
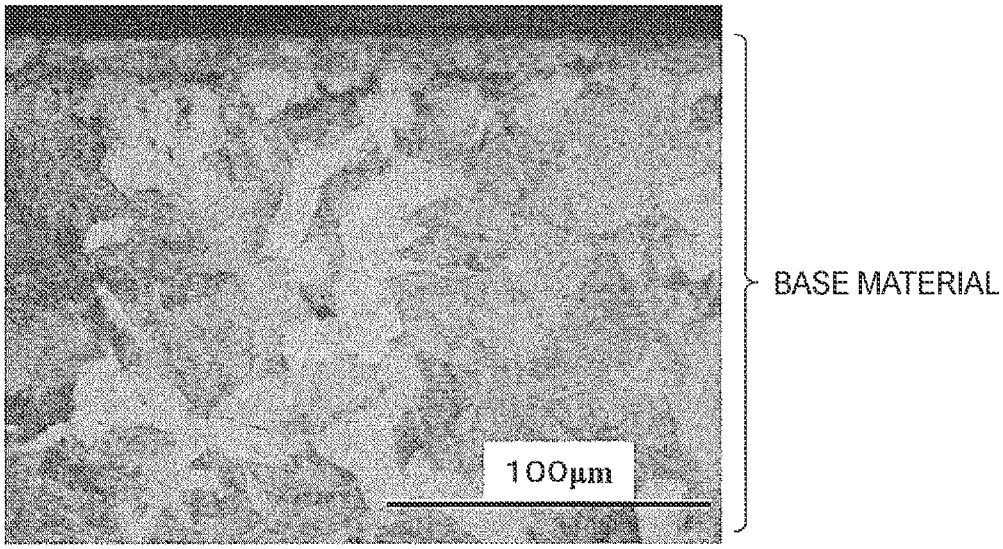
FIG. 4B is a photograph of a surface layer in a cross section of a specimen according to Comparative Example 3.

The specimens of Example 1 and Comparative Example 3 were cut, and surface layers of the specimens in the cross sections were observed. FIG. 4A is a photograph of a surface layer in a cross section of the specimen according to Example 1. FIG. 4B is a photograph of a surface layer in a cross section of the specimen according to Comparative Example 3.

[Result 1]

As shown in FIG. 4A, a nitrided layer was formed on the surface of the specimen of Example 1. However, as shown in FIG. 4B, no nitrided layer was formed on the surface of the specimen of Comparative Example 3. No nitrided layer was formed on the surfaces of the specimens of Comparative Examples 1, 2, and 4 similarly to Comparative Example 3.

[Consideration 1]

In Comparative Example 1, since the temperature of the specimen dropped in the surface treatment process, it is thought that hardly any nitrogen in ammonia gas solid-solutionized in the specimen. In addition, regarding Comparative Example 1, even if a pressure of ammonia gas was increased as in Comparative Example 2, and even if a pressure and a flow rate of ammonia gas were increased as in Comparative Example 3, since the temperature of the specimen dropped, it is thought that hardly any nitrogen in ammonia gas solid-solutionized in the specimen. On the other hand, in Comparative Example 4, while an atmosphere in the chamber was heated by a heater in the surface treatment process, ammonia gas is thought to have decomposed in the chamber before it came into contact with the surface of the specimen, and it is thought that hardly any nitrogen in ammonia gas solid-solutionized in the specimen.

However, in Example 1, in the surface treatment process, since the surface of the specimen was directly heated by infrared radiation, it is thought that nitrogen in ammonia gas could be solid-solutionized in the surface of the heated specimen.

EXAMPLE 2

Thermal analysis software (DEFORMHT commercially available from SFTC) was used to create a model of a steel processing object consisting of a spur gear having a 2.55 mm module, with 31 teeth, and a tooth width of 15 mm and thermal analysis was performed thereon. Specifically, as shown in Table 2, as conditions for the heating process, a pressure inside the heating chamber was set to be a reduced pressure state, a heater configured to heat an atmosphere was used to heat the processing object, a heating temperature was 1100° C., and a heating time was 20 minutes.

Next, as conditions for the surface treatment process, a pressure inside the processing chamber was 500 Pa, a flow rate of ammonia gas was 120 L/h, a lamp configured to perform infrared radiation was used to heat the processing object, a processing temperature was 1100° C., and a processing time was 10 minutes. As conditions for the cooling process, water cooling was used as a cooling method, and a cooling time was 10 seconds.

COMPARATIVE EXAMPLE 5

The same model as in Example 2 was created and thermal analysis was performed thereon. A difference from Example 2 was that a lamp configured to perform infrared radiation was used to heat a processing object regarding conditions for the heating process.

Figure 5A:
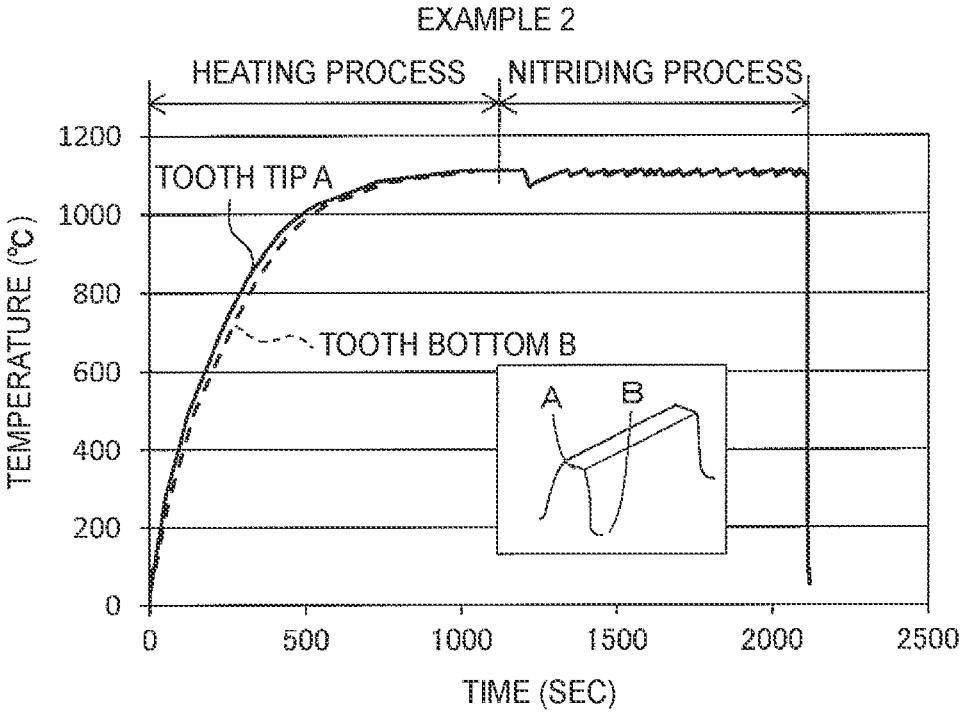
FIG. 5A shows temperature profile analysis results for a processing object according to Example 2.
Figure 5B:
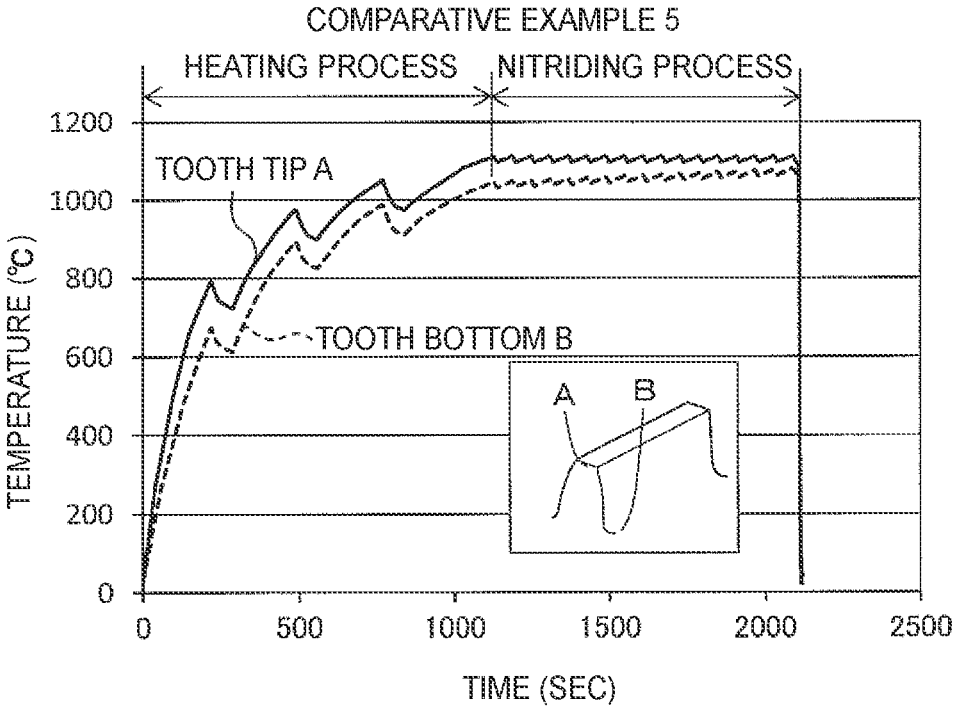
FIG. 5B shows temperature profile analysis results for a processing object according to Comparative Example 5.

FIG. 5A shows temperature profile analysis results for the processing object according to Example 2. FIG. 5B shows temperature profile analysis results for the processing object according to Comparative Example 5. FIG. 5A and FIG. 5B show temperature profiles at the tooth tip and tooth bottom indicated in the drawings.

[Result 2]

As shown in FIG. 5A, in Example 2, temperatures of a tooth tip A and a tooth bottom B in the heating process and nitriding process were substantially the same. On the other hand, as shown in FIG. 5B, in Comparative Example 5, the temperature of the tooth tip A in the heating process and nitriding process was higher than the temperature of the tooth bottom B. A temperature difference between the tooth tip A and the tooth bottom B was greater than that of Example 2.

[Consideration 2]

The temperatures of the tooth tip A and the tooth bottom B being substantially the same in the processing object of Example 2 is thought to have been caused by the fact that, since the processing object was uniformly heated by the heater in advance in the heating process, hardly any temperature difference occurred in the processing object when the lamp configured to perform infrared radiation was used for heating in the surface treatment process.

On the other hand, in the processing object of Comparative Example 5, since the processing object was heated using the lamp configured to perform infrared radiation in the heating process and surface treatment process, the tooth bottom B to which it was more difficult to perform infrared radiation compared with the tooth tip A is thought to have had a lower temperature. As described above, in Example 2, a more uniform nitriding treatment than in Comparative Example 5 is thought to have be performed on the surface of the processing object.

While the embodiments of the present disclosure have been described in detail above, the present disclosure is not limited to the above embodiments, and various design modifications can be made without departing from the spirit and scope of the present disclosure described in the claims.

Further, while the heating process is performed by heating an inert gas atmosphere in the present embodiment, for example, the interior of the heating chamber may be set to be in a reduced pressure state or a reduced pressure state close to a vacuum, the atmosphere may be heated, and thus the temperature of the surface of the processing object may be increased.

What is claimed is:

1. A surface treatment method in which a processing gas is brought in contact with a heated processing object made of steel, an element included in the processing gas is solid-solutionized, and thus a surface treatment is performed on the processing object comprising:

heating the processing object to a heating temperature by heating an atmosphere of only an inert gas in which the processing object is disposed; and performing the surface treatment by bringing the processing gas in contact with a surface of the processing object while the processing object which is heated is

TABLE 2

| | Heating process | | | | Surface treatment process (nitriding treatment) | | | | Cooling process |
|---|---|---|---|---|---|---|---|---|---|
| | Heating method | Pressure (Pa) | Heating temperature (° C.) | Heating time (min) | Heating method | Heating temperature (° C.) | Heating time (min) | Flow rate (L/h) | Cooling time (sec) |
| Example 2 | Heater | Reduced pressure | 1100 | 20 | Lamp | 1100 | 10 | 120 | 10 |
| Comparative Example 5 | Lamp | Reduced pressure | 1100 | 20 | Lamp | 1100 | 10 | 120 | 10 |

directly heated by emission of light to a processing temperature at which the surface treatment is performed, wherein the heating temperature is in a range of a temperature 100° C. lower than the processing temperature to a temperature 120° C. higher than the processing temperature.

2. The surface treatment method according to claim 1, wherein, as the surface treatment, a nitriding treatment is performed using ammonia gas as the processing gas.

3. The surface treatment method according to claim 1, wherein the emission of the light to the processing object is performed using an infrared lamp.

4. The surface treatment method according to claim 1, wherein the processing object is a gear.

5. The surface treatment method according to claim 1, wherein the heating temperature is 850° C. or higher and 1200° C. or lower.

6. The surface treatment method according to claim 1, wherein the processing object is heated to the heating temperature in a heating chamber, and wherein the surface treatment on the processing object is performed in a processing chamber, the surface treatment method further comprising transferring the processing object from the heating chamber to the processing chamber after the processing object is heated to the heating temperature.

7. A surface treatment method in which a processing gas is brought in contact with a heated processing object made of steel, an element included in the processing gas is solid-solutionized, and thus a surface treatment is performed on the processing object comprising:

heating the processing object to a heating temperature by heating an atmosphere of only an inert gas in which the processing object is disposed; and performing the surface treatment by bringing the processing gas in contact with a surface of the processing object while the processing object which is heated is directly heated to a processing temperature at which the surface treatment is performed, wherein the heating temperature is in a range of a temperature 100° C. lower than the processing temperature to a temperature 120° C. higher than the processing temperature, and the processing object is a gear.

8. A surface treatment method in which a processing gas is brought in contact with a heated processing object made of steel, an element included in the processing gas is solid-solutionized, and thus a surface treatment is performed on the processing object comprising:

heating the processing object to a heating temperature by heating an atmosphere of only an inert gas in which the processing object is disposed; and performing the surface treatment by bringing the processing gas in contact with a surface of the processing object while the processing object which is heated is directly heated to a processing temperature at which the surface treatment is performed, wherein the heating temperature is in a range of a temperature 100° C. lower than the processing temperature to a temperature 120° C. higher than the processing temperature, and the heating temperature is 850° C. or higher and 1200° C. or lower.

9. A surface treatment method in which a processing gas is brought in contact with a heated processing object made of steel, an element included in the processing gas is solid-solutionized, and thus a surface treatment is performed on the processing object comprising:

heating the processing object to a heating temperature in a heating chamber by heating an atmosphere of only an inert gas in which the processing object is disposed; and transferring the processing object from the heating chamber to a processing chamber after the processing object is heated to the heating temperature; and performing the surface treatment in the processing chamber by bringing the processing gas in contact with a surface of the processing object while the processing object which is heated is directly heated to a processing temperature at which the surface treatment is performed, wherein the heating temperature is in a range of a temperature 100° C. lower than the processing temperature to a temperature 120° C. higher than the processing temperature.

* * * * *